7/17/84 OR 4,459,757

United States Patent [19]

Lippuner et al.

[11] Patent Number: 4,459,757

[45] Date of Patent: Jul. 17, 1984

[54] ADJUSTABLE CALIBER ROD

[75] Inventors: Werner Lippuner; Ulrich Müller, both of Balgach, Switzerland

[73] Assignee: Wild Heerbrugg Aktiengesellschaft, Switzerland

[21] Appl. No.: 504,176

[22] Filed: Jun. 4, 1983

[30] Foreign Application Priority Data

Jul. 13, 1982 [CH] Switzerland ..... 4270/82

[51] Int. Cl.[3] ..... G01C 21/00; F41G 1/54

[52] U.S. Cl. ..... 33/234; 33/286

[58] Field of Search ..... 33/286, 234, 233, 247, 33/245, 178 R, 178 F, 147 K

[56] References Cited

U.S. PATENT DOCUMENTS

| | | | |
|---|---|---|---|
| 3,231,981 | 2/1966 | Welch | 33/178 R |
| 3,744,133 | 7/1973 | Fukushima et al. | 33/234 |
| 3,762,057 | 10/1973 | Kaifesh | 33/178 R |
| 3,908,282 | 9/1975 | Steffan | 33/234 |
| 4,090,305 | 5/1978 | Cassidy | 33/234 |

FOREIGN PATENT DOCUMENTS

| | | | |
|---|---|---|---|
| 647136 | 6/1937 | Fed. Rep. of Germany | 33/234 |

*Primary Examiner*—Willis Little

*Attorney, Agent, or Firm*—Roylance, Abrams, Berdo & Goodman

[57] ABSTRACT

Adjustable-caliber rod apparatus for testing and adjusting weapon barrels. The rod is used for representing the barrel bore axis in conjunction with, e.g., a sight-line testing device for adjusting sights. The rod has two three-point supports, two support points of which are pressed against the inner wall of the barrel by a third, spring-loaded mounting point. This leads to a forced orientation of the caliber rod, so that the axis thereof is aligned parallel to the barrel bore axis. Each support assembly has a fixed flange and an adjustable flange which is adjustably guided on the fixed flange. Locking devices are provided for locking the adjustable flange relative to the fixed flange, and detents between the adjustable and fixed flanges facilitates reproducible setting to specific barrel calibers.

6 Claims, 4 Drawing Figures

ADJUSTABLE CALIBER ROD

This invention relates to an adjustable caliber rod apparatus having an instrument support and having support assemblies to position the apparatus within the bore of a weapon barrel so that the instrument support lies on the bore axis.

BACKGROUND OF THE INVENTION

Devices of the general type to which the invention relates are customarily used for determining the muzzle tangent of weapon barrels, and for performing operations such as those known as bore sighting. The apparatus is inserted in the muzzle and is pressed by means of special mechanisms against the inner wall of the barrel so that the rod is centered in a precise manner in the muzzle. Testing devices, such as optical sight line testing devices, can be fitted to a pin or similar instrument mounting means provided on the rod making it possible, for example, to align sights in parallel with the barrel bore axis. This alignment can be carried out in a very confined space such as, for example, in enclosed buildings, as well as in the field.

A known caliber rod of this type is attached with the aid of a socket wrench after insertion into the muzzle. For this purpose, each of the two extreme ends of the rod carries three levers displaced by 120° which, for the purpose of attaching the rod, are pressed against the inner wall of the barrel. Although such a caliber rod can be set and used for several caliber sizes as a result of the adjustability of the levers, relatively narrow limits are placed on the practical adjustability because of the desired accuracy of measurement. Because of the nature of the mounting and guidance of the adjustable levers on the support part of the rod, the rod is positioned less precisely in the interior of the barrel the more the levers need to be opened out. Thus, the precision of measurement of such a caliber rod is less than that obtainable with individual caliber rods each of which is designed for a particular caliber of weapon. While the individual rods are usable and accurate, it is disadvantageous that one must have a complete set of rods when testing and aligning weapons of several calibers and these rods, together with the necessary storage cases for protecting them, occupy a relatively large volume and have considerable weight.

BRIEF SUMMARY OF THE INVENTION

Accordingly, an object of the present invention is to provide a caliber rod which is adjustable so as to be usable for weapons having several different barrel calibers but which, for all calibers within the adjustment range, assumes a precise position with respect to the inner wall of the bore as a result of a simple manipulation, thereby permitting precise alignment of the rod and the instrument mounting with the barrel bore axis over the entire adjustment range of the apparatus.

Briefly described, the invention includes an adjustable caliber rod apparatus insertable into a weapon barrel bore for providing mounting means on the barrel bore axis comprising an elongated body; first and second three-point support assemblies mounted on said body at longitudinally spaced locations for supporting said body in coaxial relationship within said bore, each of said support assemblies comprising a first support leg, a second support leg, a third radially extendable support leg, spring means for urging said third leg radially away from said body, and a mounting for said third leg and said spring, and means for coupling said support legs to said body in angularly separated relationship to provide a triangular support for said body within the bore with at least said third leg, said spring and said mounting being radially adjustable relative to said body.

It is particularly advantageous that the rod can be positioned very accurately with respect to the inner wall of the barrel over the entire adjustment range so that it is possible to represent the barrel bore axis with the rod for various different calibers within a permitted tolerance range.

Despite the high precision of measurement which is attainable, there is no need for there to be a separate caliber rod for each individual caliber, thus considerably reducing the inventory of such devices which must be retained and considerably improving the possibilities of flexibly using such rods.

To facilitate the manipulation of the caliber rods for individual sizes, the adjustment mechanism can be provided with catches or detents, or easily recognized markings, in order to facilitate rapid and reliable setting in each case to the desired caliber.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF PREFERRED EMBODIMENTS

Figure 1:
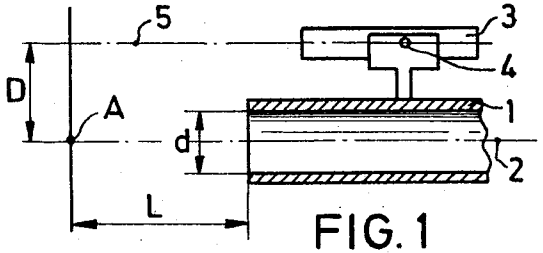
FIG. 1 is a schematic side elevation of a weapon illustrating generally the task performed by the apparatus of the present invention.

The schematic diagram of FIG. 1 shows a weapon barrel 1 having a barrel bore axis 2, the caliber of the bore being indicated at d. A sight mechanism 3 is schematically shown as being coupled to the barrel by a support, the sight being tiltable about an axis 4. The sight is mounted on the barrel in such a way that the optical axis 5 of the sight has a specific parallax distance D from the barrel bore axis 2 at a specific range L from the muzzle. One adjustment which must be performed on a system of this type is to release a locking mechanism so that the sight 3 can be pivoted about the axis or fulcrum 4 and adjust the sight such that when the axis 2 is aligned with point A at the specified distance, the sight is directed at a point a distance D from point A. For this purpose, an adjustable caliber rod apparatus 10 in accordance with the invention is inserted into the barrel, the mechanism being provided with an attachment means 11 on which can be mounted a conventional sighting mechanism such as an optical telescope by which the barrel can be moved to a clearly defined measuring point A, as viewed through the optical telescope which is not illustrated. Then, by tilting the sight about fulcrum 4, the sight can be aligned to a point the desired distance D from point A.

Figure 2:
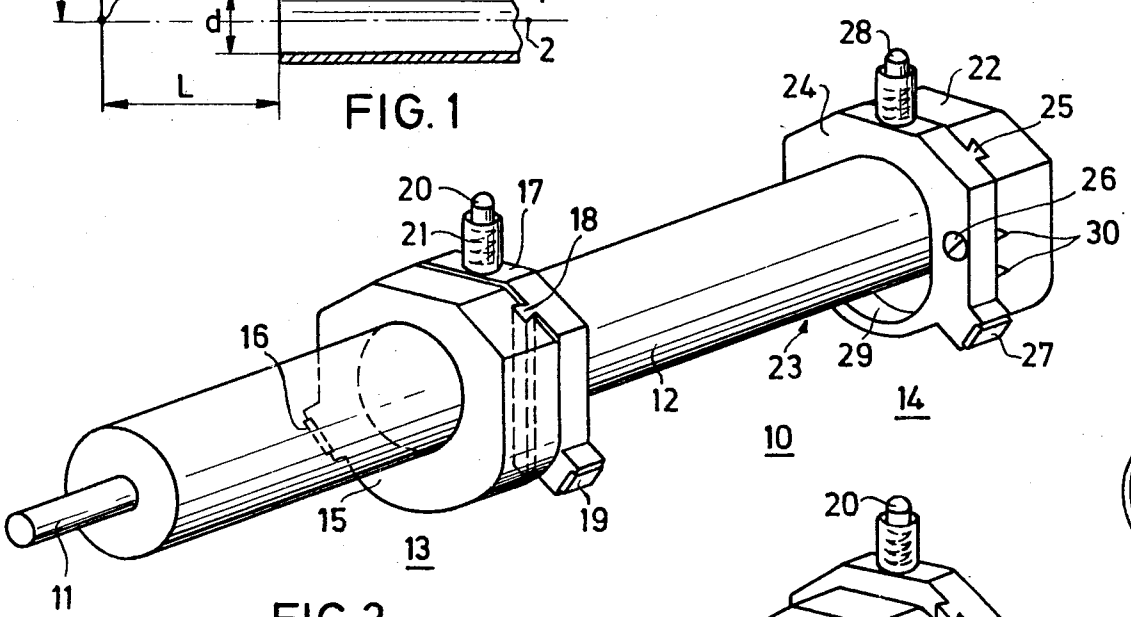
FIG. 2 is a perspective view of a preferred embodiment of an apparatus in accordance with the invention showing the adjusting mechanism in the maximum caliber position.
Figure 3:
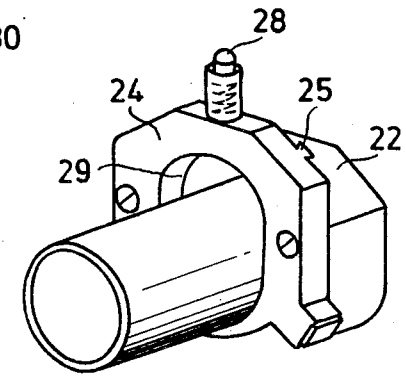
FIG. 3 is a partial perspective view of a portion of the apparatus of FIG. 2 with the adjustment set in the smallest possible caliber position.

The mechanism in accordance with the invention for performing this function, as shown in FIGS. 2 and 3, includes an elongated rod-like support body 12 having support assemblies 13 and 14 mounted thereon in longitudinally spaced relationship. Each of these support assemblies provides a three-point support for an end of the elongated body 12, support 13 including a fixed flange 15 which is rigidly attached to body 12 and which, in the present embodiment, is provided with a leg having a distal end 16 for contacting the inner wall of the barrel and providing a first mounting point. An adjustable flange 17 is coupled to flange 15 by a guide mechanism 18 which is illustrated as a dovetail guide assembly. The guide and locking means associated therewith will be described in greater detail in connection with support assembly 14 because they are more easily seen in that portion of the drawing.

The adjustable flange 17 is provided with a leg having a distal end 19 forming a second contact point, and flange 17 also has a spring-loaded mounting leg 20. Leg 20 is urged radially outwardly by a spring 21, illustrated as a compression coil spring, and forms the third support leg of a triangular arrangement. Positioning of the ends of the three legs within the bore of the weapon brings about the exact positioning of support 13 within the inner wall of the barrel. Spring 21 must be sufficiently strong to correct for the weight of the rod as well as initial minor imprecisions in positioning so that a clearly defined, rigid seating of the three-point support against the inner wall of the barrel is attained.

The second three-point support 14, in a manner similar to support 13, includes a first flange 22 fixedly attached to body 12 and provided with a mounting leg indicated generally at 23 which is hidden behind body 12 in FIG. 1. An adjustable flange 24 includes a guide member 25 engaging a slot in member 22 and includes locking means 26 for arresting the position of flange 24 relative to flange 22. Adjustable flange 24 is provided with a fixed support 27 and a spring-loaded support 28, in a manner similar to members 19 and 20, to again accomplish clearly defined positioning with respect to the inner wall of the barrel. Flange 24 is centrally provided with an elongated opening 29 which permits flange 24 to be displaced by the sliding of guide rail 25 in its mating slot with respect to body 12 and fixed flange 22.

As previously indicated, in the embodiment being discussed, the guidance members 25 and 18 comprise dovetail guides. However, it is also possible to use other forms of guides for this purpose, particularly linear guides. In the vicinity of guides 18 and 25, and in the vicinity of the contact surface between fixed flanges 15, 22 and the adjustable flanges 17, 24, respectively, the present embodiment includes detents 30 which permit rapid adjustment of the device to a selected barrel caliber. As will be recognized, the detents are relatively simple protrusions on, for example, member 24 with mating recesses in the adjacent surface of member 22. The detents can also be provided with indicia designating the caliber chosen by movement to that position.

Locking means 26 in the embodiment shown comprises set screws which are used for locking the desired setting of adjustable flanges 17, 24 with respect to fixed flanges 15, 22, respectively.

FIG. 3 shows the upper end position of movement of adjustable flange 24 relative to fixed flange 22. It will be recognized from FIGS. 2 and 3 that the fixed support point 16, 19 or 23, 27 constitutes prismatic support portions with respect to the inner wall of the bore which can be forcibly oriented with respect to the inner wall by the spring-loaded action of support points 20, 28 in such a way that the axis of body 12 extends parallel with and is aligned with the axis 2 according to FIG. 1. The spring-loaded supports 20, 28 act as a pressing means to obtain the desired forced orientation. This forced orientation of rod 10 with respect to the inner wall of the barrel is independent of the angular position at which the rod 10 is inserted into the barrel 1. All that is important for the aforementioned testing and adjusting process is that the axis of the caliber rod 10 is parallel with the bore axis 2.

Figure 4:
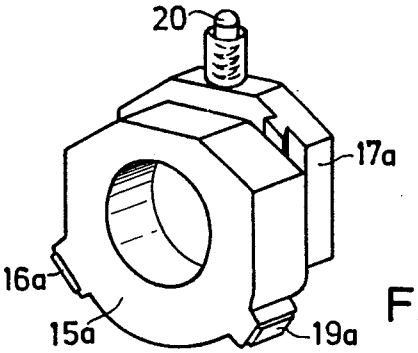
FIG. 4 is a perspective view of a further embodiment of a support mechanism in accordance with the invention.

FIG. 4 shows a modification in which the two fixed mounting legs **16*a*, 19*a* are provided on fixed flange 15*a* while the adjustable flange 17*a* is provided only with the spring-loaded mounting point 20. This embodiment also provides a prismatic support resulting from the fixed mounting point 16, 19 which is forcibly oriented by pressing means, in the form of the spring-loaded mounting point 20, with respect to the inner wall of the barrel. The adjustment of the adjustable flanges 17*a*, 24*a* with respect to the fixed flanges 15*a*, 22*a* in this embodiment preferably takes place in a plane which is perpendicular to the barrel bore axis 2**. However, it is also possible to use other adjustment means, such as longitudinal curved guides, in order to achieve the desired pressing of the prismatic support portions against the inner wall of the barrel.

In order to facilitate the adjustment between flanges 17, 24 and fixed flanges 15, 22, it is possible to use actuating members, e.g., eccentrics not shown in the drawings. Such devices are particularly suitable for adjusting between two different calibers. As a result of such an eccentric adjustment device, the easy repeatability of desired caliber settings is ensured.

All portions of the caliber rod are undetachably joined to the apparatus. No individual components need to be changed or supplemented when adjusting to a different caliber. Thus, the caliber rod is particularly suitable for rough use in the field because there is no need to carry any replacement or additional parts, while still permitting the testing and adjustment of different barrel calibers with the same rod apparatus.

While certain advantageous embodiments have been chosen to illustrate the invention, it will be understood by those skilled in the art that various changes and modifications can be made therein without departing from the scope of the invention as defined in the appended claims.

What is claimed is:

1. An adjustable caliber rod apparatus insertable into a weapon barrel bore for providing mounting means on the barrel bore axis, comprising:

an elongated body;

first and second three-point support assemblies mounted on said body at longitudinally spaced locations for supporting said body in axis-parallel relationship within said bore, each of said support assemblies comprising a first support leg, a second support leg, a third radially extendable support leg, spring means for urging said third leg radially away from said body, and a mounting for said third leg and said spring, and means for adjustably coupling said support legs to said body in angularly separated relationship to provide a triangular support for said body within the bore with at least said third leg, said spring and said mounting being radially adjustable relative to said body.

2. An apparatus according to claim 1 wherein each of said support assemblies includes a first flange fixedly attached to said body and carrying said first support leg, a second flange adjustably coupled to said first flange and including said mounting for said spring and third leg, and guide means between said first and second flanges for guiding the adjustment thereof.

3. An apparatus according to claim 2 wherein said guide means includes a straight bar extending generally perpendicular to a line between the distal ends of said first and second legs and perpendicular to the bore axis.

4. An apparatus according to claim 2 wherein said second flange carries said second leg angularly displaced from said third leg.

5. An apparatus according to claim 2 and including detent means between said first and second flanges for defining repeatable setting points in the adjustment of said second flange relative to said first flange, and locking means for locking the flanges in a selected set point.

6. An apparatus according to claim 2 wherein said first and second legs are both carried by said first flange.

* * * * *